United States Patent [19]

Seiler

[11] Patent Number: 4,947,500

[45] Date of Patent: Aug. 14, 1990

[54] THERAPEUTIC MATTRESS, IN PARTICULAR FOR PREVENTING OR CURING DECUBITUS ULCERS

[75] Inventor: Walter O. Seiler, Allschwil, Switzerland

[73] Assignee: OBA AG and Hans Völlmin, Switzerland

[21] Appl. No.: 378,137

[22] Filed: Jul. 11, 1989

[30] Foreign Application Priority Data

Aug. 25, 1988 [CH] Switzerland ..... 3164/88

[51] Int. Cl.[5] ..... A61G 7/04

[52] U.S. Cl. ..... 5/453; 5/455; 5/464; 5/481

[58] Field of Search ..... 5/61, 453, 455, 456, 5/462, 464, 481, 446

[56] References Cited

U.S. PATENT DOCUMENTS

| | | | |
|---|---|---|---|
| 3,426,373 | 2/1969 | Scott et al. | 5/456 |
| 3,678,520 | 7/1972 | Evans | 5/453 |
| 3,717,885 | 2/1973 | DeMare | 5/61 |
| 3,935,604 | 2/1976 | Collins | 5/455 X |
| 4,394,784 | 7/1983 | Swenson et al. | 5/453 |
| 4,697,290 | 10/1987 | Alklind et al. | 5/61 |

FOREIGN PATENT DOCUMENTS

| | | | |
|---|---|---|---|
| 2424440 | 12/1974 | Fed. Rep. of Germany | 5/455 |
| 2744412 | 4/1979 | Fed. Rep. of Germany | 5/475 |

*Primary Examiner*—Michael F. Trettel

*Attorney, Agent, or Firm*—Toren, McGeady & Associates

[57] ABSTRACT

The therapeutic mattress comprises an elastic but hard base layer of foam material. Over this base layer is applied a frame composed of a hard part and a soft part. On its upper side the mattress is bounded by a soft cover layer. Between or inside the aforementioned parts is disposed a core comprising essentially two groups of three air-cushions each and an insert. Each of the two air-cushion groups has its own connection to a pumping station equipped with a programmable control device. Using this control device it is possible to set up the most varied programs and cycles for moving a patient and positioning him, or repositioning him, as often as needed. In this way, decubitus ulcers may be prevented from developing, but in addition, conditions may be created to enable ulcers already developed to be healed.

6 Claims, 2 Drawing Sheets

THERAPEUTIC MATTRESS, IN PARTICULAR FOR PREVENTING OR CURING DECUBITUS ULCERS

BACKGROUND OF THE INVENTION

1. Field of the Invention

The present invention refers to a therapeutic mattress, in particular for preventing or curing decubitus ulcers. The decubitus ulcer is not an independent illness but develops secondarily to a primary illness that forces the patient into immobility. It develops invariably against the background of a protein deficiency syndrome, a consequence of malnutrition frequently found in the aged. This deficiency affects the mechanical properties of the patient's bodily tissues, which thus become less resistant to the pressures they are subjected to as the weight of the patient's body presses such tissues against the mattress the patient is lying on. Such ulcers are very common in the chronically ill and represent feared complications frequently more dangerous than the primary illness itself. Once developed, the wound gets easily infected and must be treated against such infections. Also, the mattresses to be used for such patients are designed to make the patient's total body weight relatively uniformly distributed on the surface of the mattress, to make the specific pressure at any one point of the skin as small as possible, to prevent any further damage to the tissue. In addition, the time during which the pressure acts on a particular region of the skin is kept within allowable limits by moving the patient periodically and keeping his exposure compatible with the status of his tissues. These measures must be applied in all cases in which a decubitus ulcer has already developed if a cure thereof is endeavoured, but they are advisable if only the prevention of such ulcers is aimed at.

2. Description of the Prior Art

Known therapeutic mattresses of the aforementioned kind are excessively soft. One such known mattress having a height of about 20 cm is referred to as alternating pressure mattress and is composed of two parts tapered in cross-section and disposed on top of each other, and is arranged to have cushions individually inflatable and deflatable. On this mattress is placed a very soft second mattress of a thickness of 12 to 15 cm. These alternating pressure mattresses have not been very successful. On the one hand, they are too high when used together with the stated second mattress. On the other hand, they do not properly adapt to a class of bed frames that comprise hinges extending perpendicular to the longitudinal direction of the bed to form a head wedge and a foot wedge. Also when deflating one of the mattress components, the patient will be in danger of rolling out of bed, or of rolling against the safety grid that may be provided.

SUMMARY OF THE INVENTION

Hence from what has been explained heretofore it is apparent that there is still needed a therapeutic mattress, in particular for preventing or curing decubitus ulcers, which does not have the drawbacks and limitations of the prior art proposals.

It is thus an object of the invention to provide a therapeutic mattress of the aforementioned kind, which avoids the drawbacks and limitations of the prior art mattresses.

It is a more specific object of the invention to create a therapeutic mattress of moderate thickness yet sufficiently stable, and which comprises an upper surface sufficiently soft to give the patient comfort, and which does not require the addition of a second soft mattress to be able to fulfill this requirement.

Yet a further object of the present invention is to create a therapeutic mattress capable of adapting to bed frames comprising hinges, to thus avoid the danger of the patient's rolling out of bed, or rolling against any safety grid that may be provided.

The foregoing and other objects are attained in accordance with the present invention by creating a therapeutic mattress, in particular for preventing or curing decubitus ulcers, the mattress consisting of an elastic but hard base layer of foam material, a cover layer, soft as compared to the base layer, a frame layer of elastic material disposed between the two stated layers, and a core disposed between or inside of all of the aforementioned components. The core is arranged to comprise two groups of air-cushions disposed mirror-inverted to each other in relation to a central plane extending in the longitudinal direction of the mattress but perpendicular to the plane thereof. Each group of air-cushions is made to consist of three cushions rotatable or pivotable relative to each other, in their air-filled or inflated state, through an angle of at least 90° and arranged to taper toward the stated central plane, the two groups of air-cushions being operatively connected with a pumping or compressor station, to enable the air-cushions of one group to be inflated and deflated independently of the air-cushions of the other group.

As a further novel feature of the invention the pumping or compressor station is equipped with a control device adapted to subject the two groups of air-cushions to various operating cycles of inflation and deflation, such cycles being programmable regarding the sequence and duration of the individual steps as well as any interruptions or pauses between such steps.

The therapeutic mattress of the invention displays all of the features required for limiting patient tissue pressures and for successfully preventing or curing decubitus ulcers, while also relieving the attendant personnel of the need to reposition the patient at frequent intervals, a task requiring the same subtleness and accuracy each time and more adapted to automatic than to manual execution. Also, by its suitable design and the proper combination of materials, the mattress of the invention is realized sufficiently stable and of adequate softness, while not exceeding 26 cm in height in the inflated state of the air-cushions. Furthermore, the mattress is adaptable to bed frames comprising hinges, thus avoiding the danger of the patient's rolling out of bed or against any safety grid that may be provided.

BRIEF DESCRIPTION OF THE DRAWINGS

Further objects and advantages of the present invention will become apparent from the following detailed description of preferred embodiments by making reference to the appended drawings There show.

DETAILED DESCRIPTION OF THE PREFERRED EMBODIMENTS

Figure 1:
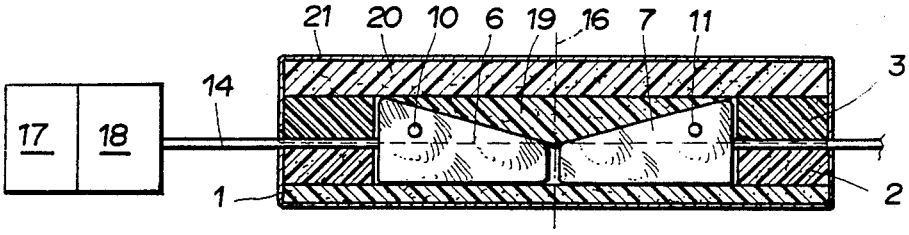
FIG. 1: a cross-section through a therapeutic mattress viewed perpendicular to the line I—I of FIG. 2, FIG. 2: a top view of the mattress, the insert and the cover layer being partially broken away.
Figure 2:
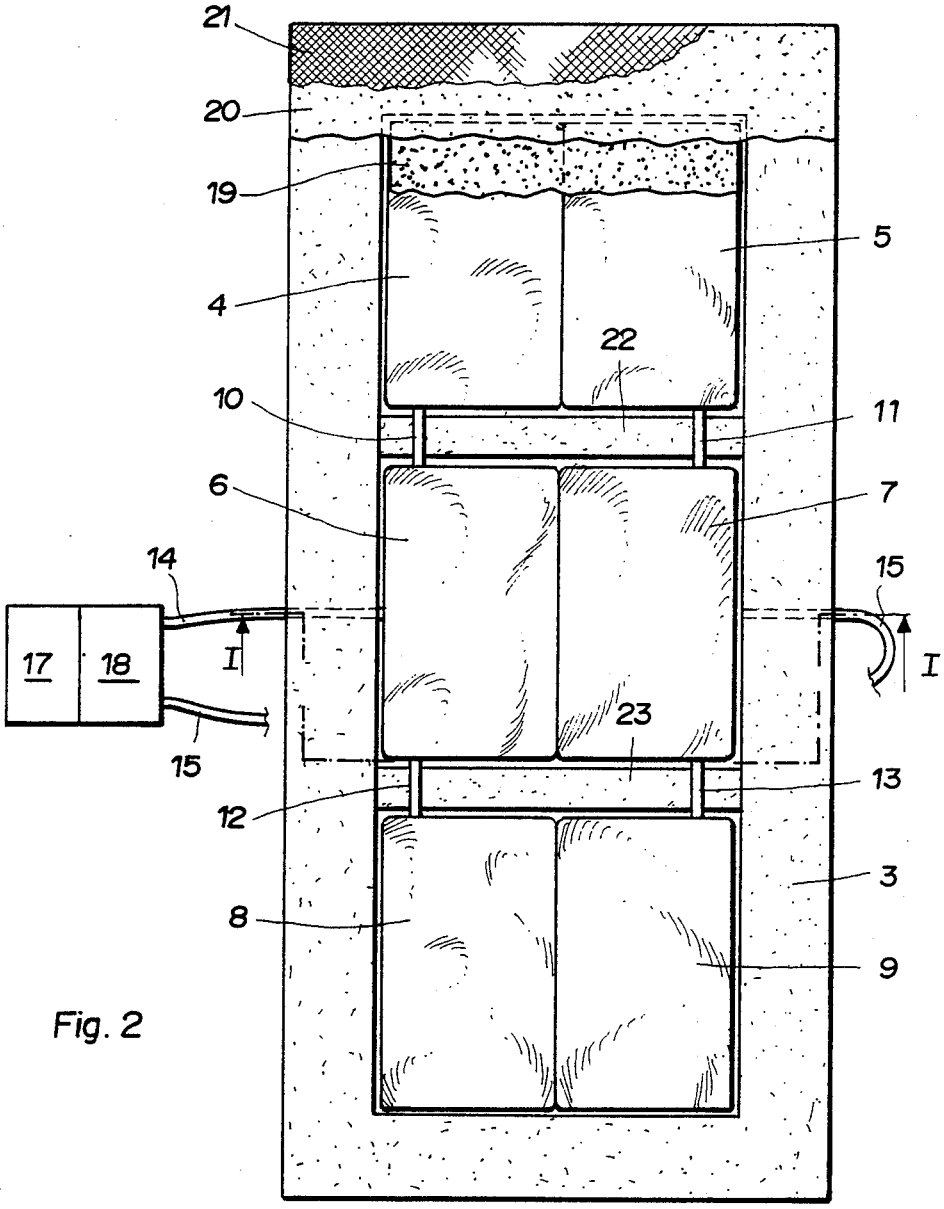
Figure 3:
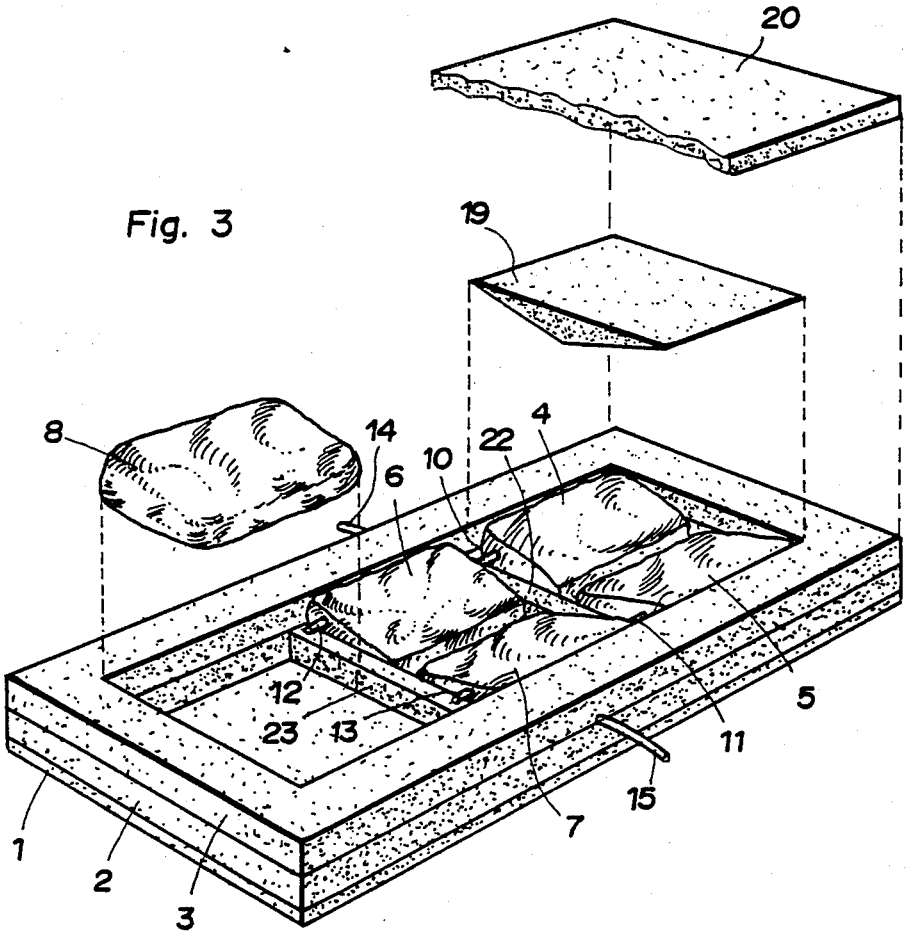
FIG. 3: a perspective view of the mattress.

The mattress shown in the drawing comprises a base layer 1 of hard foam approximately 3 cm thick. On this base layer 1 rests an elastic frame layer composed of two foam strips disposed on one another, each strip being about 15 cm wide and 7 to 8 cm high, the lower strip being identified by the reference numeral 2 and having a hardness similar to that of the base layer 1. The upper strip 3 is appreciably softer. By preference, all of the aforestated parts are mutually glued together to some extent, to make them maintain their positions relative to each other. Between i.e. inside of the aforestated components is disposed the core. The core comprises six air-cushions identified by the reference numerals 4, 5, 6, 7, 8, 9, divided into two groups of three cushions each, the three cushions of each group being connected among themselves by way of an air-conduit, in particular, the air-cushions 4, 6 and 8 by means of the conduit 10/12, and the air-cushion 5, 7 and 9 by means of the conduit 11/13. These two groups of air-cushions supported by the base layer 1 are disposed mirror-inverted to each other in relation to the central plane 16 that extends in the longitudinal direction of the mattress but perpendicular to the plane thereof. As shown in the drawing these cushions taper toward the central plane 16 in a way to have—in their air-filled or inflated state—the cushion height only about 7 cm at this central plane 16, and about 15 cm at the opposite cushion edge, i.e. adjacent the frame layer. The taper angle of the cushions is between 16 to 20 degrees. One of the air-cushion groups is connected via a hose 14 and the other via a hose 15 with a pumping station 18 indicated only schematically in the drawing and provided with a control device 17. The core of the therapeutic mattress also includes an insert consisting of soft foam material and arranged to rest on all of the air-cushions and to taper outwardly from the central plane 16 and toward the longitudinal edges, the insert being identified in the drawing by the reference numeral 19 and arranged to have its upper surface extend parallel to the plane of the foam base layer 1. At its top the mattress comprises a cover layer 20, very soft as compared to the base layer 1, and arranged to extend over the entire upper surface of the mattress This cover layer 20 is preferably connected with the frame layer, at least at discrete locations, to make the mattress form a unitary whole. By providing on the two sides of the central plane 16 one group each of three air-cushions adapted to be held apart by the transverse straps 22 and 23, rather than providing a single-piece air-cushion, it is made possible to have the mattress as flexible as required for use on a bed frame having its mattress support element comprise three parts connected with each other by way of hinges and arranged to be pivotable or rotatable relative to each other, specifically, one part serving as head wedge and two other parts serving the purpose of properly positioning the thigh and the lower leg relative to each other, to enable the formation of an elevated structure to serve as support for the popliteal space of the knee joint.

As is the case with conventional mattresses, this mattress too is preferably protected by a fabric casing 21 provided with openings for the two hoses 14 and 15 leading to the pumping or compressor station 18. This pumping station 18 may be arranged to comprise a pump or a compressor for generating air pressure and valves serving the purpose of inflating and deflating the two air-cushion groups 4, 6, 8 and 5, 7, 9, respectively. If installed in a modern hospital or old-age home the pumping station would not have a pump in the patient's room, but only a connector stud or fitting for connecting the centrally located pumping station with the pressurized-air piping system of the patient's room and the control valves adapted to connect the hoses 14 and 15 with the connector stud or the relief opening or to close off the same, as required.

The control device serves the purpose of selecting the desired or required pumping and operating cycle as well as for inserting pauses of programmable duration of up to 30 minutes between the individual steps of the cycle, as well as for freely choosing the times for inflation and deflation, suitable values for these times having been found to be in the range of 1 to 3 minutes and preferably between 2 and 3 minutes. The control device is preferably adapted for supplying the following sequences or cycles:

Cycle A:
(a) Deflating one air-cushion group
(b) Inflating this one air-cushion group
Cycle B:
(a) Deflating the other air-cushion group
(b) Inflating this other air-cushion group
Cycle C:
(a) Deflating one air-cushion group
(b) Inflating this one air-cushion group
(c) Deflating the other air-cushion group
(d) Inflating this other air-cushion group By deflating one air-cushion group the patient is moved into a new position in a very careful manner, so that not the same bodily parts of the patient will constantly be subjected to the stress of his bodily weight, a condition required for preventing decubitus ulcers from developing.

Based on these cycles the following programs of movements are for example possible:

1. (a) Carefully tilting the patient from a horizontal position into a left lateral position, a process requiring two minutes;
(b) letting him lie in this position for 15 minutes;
(c) returning the patient into the horizontal supine position, a process again requiring about two minutes;
(d) letting him lie in this position for 15 minutes; then repeating the steps a to d.

2. (a) Carefully tilting the patient from the horizontal into the right lateral position, a process requiring $1\frac{1}{2}$ minutes;
(b) letting him lie in this position for 20 minutes;
(c) returning the patient into the horizontal supine position, a process again requiring $1\frac{1}{2}$ minutes;
(d) letting him lie in this position for 20 minutes; then repeating the steps a to d.

3. (a) Tilting the patient from the horizontal position into the right lateral position, a process requiring one minute;
(b) Letting him lie in this position for 25 minutes;
(c) returning the patient into the horizontal supine position, a process again requiring about one minute;
(d) letting him lie in this position for 25 minutes;
(e) tilting him from this position into the left lateral position, a process requiring one minute;
(f) letting him lie in this position for 25 minutes;

(g) returning him into the horizontal position, a process requiring one minute;

(h) letting him lie in this position; then repeating the steps a to h.

4. A program similar to 3, with (d) and (h) omitted, meaning that the times for (d) and (h) are zero.

It is of course possible to provide a control device wired up for many additional programs or cycles, or to provide for the possibility of programming the cycle individually, in accordance with the momentary needs of a specific patient.

While there are shown and described present preferred embodiments of the invention, it is to be distinctly understood, that the invention is not limited thereto but may be otherwise variously embodied and practiced within the scope of the appended claims.

What is claimed is:

1. Therapeutic mattress, in particular for preventing or curing decubitus ulcers, the mattress having a longitudinal direction and a plane extending in the longitudinal direction and defining an upper surface of said mattress comprising an elastic base layer of hard foam material, a cover layer that is soft as compared to the base layer, said cover layer spaced upwardly from said base layer, a frame layer of elastic material located between the base and cover layers, and a core disposed within said frame layer and extending between said base and cover layers, the core comprises two groups of air-cushions disposed mirror-inverted to one another in relation to a central plane extending in the longitudinal direction of the mattress but perpendicular to the plane thereof, each group comprising three inflatable and deflatable cushions rotatable or pivotable relative to one another, in an inflated state, through an angle of at least 90°, and transversely of the longitudinal direction said cushions taper downwardly toward said base layer and inwardly toward said central plane, the two groups of air-cushions being operatively connected with a pumping or compressor station, to enable the air-cushions of one group to be inflated and deflated independently of the air-cushions of the other group.

2. Therapeutic mattress as claimed in claim 1, wherein the pumping or compressor station is equipped with a control device adapted, in its operative state, to direct the pump or compressor to subject the inflated air-cushions to at least one of the following operating cycles, repeated as many times as desired:

Cycle A: (a) Deflating one air-cushion group
(b) Inflating the one air-cushion group
Cycle B: (a) Deflating another air-cushion group
(b) Inflating the another air-cushion group
cycle C: (a) Deflating the one air-cushion group
(b) Inflating the one air-cushion group
(c) Deflating the another air-cushion group
(d) Inflating the another air-cushion group, and said control device arranged to freely insert during and between any of the repeated cycles, interruptions or pauses of programmable duration of up to 30 minutes and to adjust the speed of inflation and deflation of the air-cushions to enable the selection of inflation and deflation times between 60 and 180 seconds.

3. Therapeutic mattress as claimed in claim 2, wherein said control device is arranged to adjust the speed of inflation and deflation of the air-cushions to enable the selection of inflation and deflation time between 120 and 180 seconds.

4. Therapeutic mattress as claimed in claim 1, wherein the air-cushions have, in the inflated state, a height between 14 and 16 cm and a taper angle between 16° and 20°.

5. Therapeutic mattress as claimed in claim 1, wherein the height of the mattress is 26 cm or less.

6. Therapeutic mattress as claimed in claim 1, wherein the core includes an insert of soft foam material arranged to rest on all of the air-cushions and to taper from the central plane toward edges of the air-cushions extending in the longitudinal direction of said mattress.

* * * * *